US012061035B2

(12) United States Patent
Brandon-Jones et al.

(10) Patent No.: US 12,061,035 B2
(45) Date of Patent: Aug. 13, 2024

(54) ICE DISPENSING SYSTEM

(71) Applicant: Costa Express Limited, Buckinghamshire (GB)

(72) Inventors: Julian Brandon-Jones, London (GB); Tim Schuller, London (GB); Alasdair Macbean, London (GB); Enrico Miraglia Del Giudice, London (GB); Tim Burnham, Buckinghamshire (GB); Nathan Taylor, Buckinghamshire (GB); Sam Dedman, Buckinghamshire (GB)

(73) Assignee: COSTA EXPRESS LIMITED, Buckinghamshire (GB)

( * ) Notice: Subject to any disclaimer, the term of this patent is extended or adjusted under 35 U.S.C. 154(b) by 397 days.

(21) Appl. No.: 17/594,079

(22) PCT Filed: Apr. 3, 2020

(86) PCT No.: PCT/EP2020/059605
§ 371 (c)(1),
(2) Date: Oct. 1, 2021

(87) PCT Pub. No.: WO2020/201526
PCT Pub. Date: Oct. 8, 2020

(65) Prior Publication Data

US 2022/0146177 A1 May 12, 2022

(30) Foreign Application Priority Data

Apr. 3, 2019 (GB) ..... 1904722

(51) Int. Cl.
*F25C 5/20* (2018.01)

(52) U.S. Cl.
CPC ..... *F25C 5/20* (2018.01); *F25C 2400/04* (2013.01); *F25C 2400/12* (2013.01); *F25C 2700/00* (2013.01)

(58) Field of Classification Search
CPC ..... F25C 5/20; F25C 5/22; F25C 2400/04; F25C 2600/04
See application file for complete search history.

(56) References Cited

U.S. PATENT DOCUMENTS 2,449,132 A 9/1948 Lucia
6,827,529 B1 * 12/2004 Berge ..... F25C 5/20 406/28

(Continued)

FOREIGN PATENT DOCUMENTS

CN 101346085 A 1/2009
CN 101512263 A 8/2009

(Continued)

OTHER PUBLICATIONS

PCT International Search Report and Written Opinion of the ISA for PCT International Application No. PCT/EP2020/059605, filed Apr. 3, 2020, mailed Jul. 9, 2022, 14 pages.

(Continued)

*Primary Examiner* — Eric S Ruppert
(74) *Attorney, Agent, or Firm* — Merchant & Gould P.C.

(57) ABSTRACT

The invention relates to an ice dispensing system comprising an ice hopper, an ice chute for transporting ice from the ice hopper to a dispensing outlet or a waste outlet, an ice dispensing element for dispensing ice from the hopper into the ice chute, an ice directing element having a first position for directing ice to the waste outlet and a second position for directing ice to the dispensing outlet, and a controller for controlling the ice dispensing element and the position of the ice directing element. Also provided is a beverage dispensing machine comprising the ice dispensing system of the invention and a method for dispensing ice from the ice dispensing system or beverage dispensing machine of the invention.

21 Claims, 1 Drawing Sheet

(56) References Cited

U.S. PATENT DOCUMENTS

| | | | | |
|---|---|---|---|---|
| 2001/0027654 | A1 | 10/2001 | Shapiro et al. | |
| 2006/0059939 | A1 | 3/2006 | An et al. | |
| 2008/0134709 | A1 | 6/2008 | Fischer et al. | |
| 2009/0165492 | A1 | 7/2009 | Wilson | |
| 2009/0166385 | A1* | 7/2009 | Davis | F25C 5/22 62/344 |
| 2010/0313595 | A1 | 12/2010 | Seo | |
| 2011/0138828 | A1 | 6/2011 | Leclear et al. | |
| 2012/0198870 | A1* | 8/2012 | Erbs | F25C 1/12 62/347 |
| 2012/0227421 | A1 | 9/2012 | Kim et al. | |

FOREIGN PATENT DOCUMENTS

| | | | |
|---|---|---|---|
| CN | 102177533 | A | 9/2011 |
| DE | 202009001489 | U1 | 6/2010 |
| DE | 202009001490 | U1 | 8/2010 |
| DE | 202010010556 | U1 | 11/2010 |
| EP | 0887146 | A2 | 12/1998 |
| EP | 1938030 | A2 | 7/2008 |
| EP | 1965683 | A2 | 9/2008 |
| EP | 2215941 | A1 | 8/2010 |
| EP | 2315568 | A1 | 5/2011 |
| EP | 2364492 | A1 | 9/2011 |
| EP | 2378893 | A1 | 10/2011 |
| EP | 2215940 | B1 | 7/2012 |
| EP | 2819946 | A1 | 1/2015 |
| EP | 2355667 | B1 | 4/2015 |
| EP | 2969907 | A1 | 1/2016 |
| EP | 2989046 | A1 | 3/2016 |
| EP | 2373572 | B1 | 2/2017 |
| EP | 2359260 | B1 | 6/2017 |
| EP | 3185731 | A1 | 7/2017 |
| EP | 2847527 | B1 | 11/2018 |
| EP | 3411326 | A1 | 12/2018 |
| ES | 2211946 | T3 | 7/2004 |
| ES | 2263606 | T3 | 12/2006 |
| GB | 2369610 | B | 3/2005 |
| GB | 2526156 | A | 11/2015 |
| JP | 2004326185 | A * | 11/2004 |
| JP | 2004326605 | A * | 11/2004 |
| JP | 2018-017449 | A | 2/2018 |
| JP | 2018 017451 | A | 2/2018 |
| KR | 2007 0074354 | A | 7/2007 |
| KR | 2009 0111718 | A | 10/2009 |
| KR | 2013 0027003 | A | 3/2013 |
| TW | 201829968 | A | 8/2018 |
| WO | WO 01/27544 | A2 | 4/2001 |
| WO | WO-03042612 | A2 | 5/2003 |
| WO | WO-2007028029 | A2 | 3/2007 |
| WO | WO-2007072374 | A2 | 6/2007 |
| WO | WO-2008143752 | A1 | 11/2008 |
| WO | WO-2008143758 | A1 | 11/2008 |
| WO | WO-2008143991 | A1 | 11/2008 |
| WO | WO-2009059405 | A1 | 5/2009 |
| WO | WO-2010022291 | A2 | 2/2010 |
| WO | WO-2010022336 | A2 | 2/2010 |
| WO | WO-2010022345 | A2 | 2/2010 |
| WO | WO-2010022361 | A2 | 2/2010 |
| WO | WO-2010022385 | A2 | 2/2010 |
| WO | WO-2010022506 | A1 | 3/2010 |
| WO | WO-2010027717 | A2 | 3/2010 |
| WO | WO-2010068638 | A1 | 6/2010 |
| WO | WO-2010077696 | A1 | 7/2010 |
| WO | WO-2010077697 | A1 | 7/2010 |
| WO | WO-2010077698 | A1 | 7/2010 |
| WO | WO-2010077699 | A1 | 7/2010 |
| WO | WO-2010077700 | A1 | 7/2010 |
| WO | WO-2010101585 | A1 | 9/2010 |
| WO | WO-2011071606 | A1 | 6/2011 |
| WO | WO-2013124514 | A1 | 8/2013 |
| WO | WO-2013130511 | A1 | 9/2013 |
| WO | WO-2013169732 | A1 | 11/2013 |
| WO | WO-2014160346 | A1 | 10/2014 |
| WO | WO-2014175965 | A1 | 10/2014 |
| WO | WO-2015002874 | A2 | 1/2015 |
| WO | WO-2016029294 | A1 | 3/2016 |
| WO | WO-2016069106 | A1 | 5/2016 |
| WO | WO-2017015576 | A1 | 1/2017 |
| WO | WO-2017059483 | A1 | 4/2017 |
| WO | WO-2017124355 | A1 | 7/2017 |
| WO | WO-2017124356 | A1 | 7/2017 |
| WO | WO-2017124357 | A1 | 7/2017 |
| WO | WO-2017136555 | A1 | 8/2017 |
| WO | WO-2018052930 | A2 | 3/2018 |

OTHER PUBLICATIONS

Search Report for GB 1904722.4, dated Sep. 13, 2019, 3 pages.

PCT International Report on Patentability for PCT International Application No. PCT/EP2020/059605, filed Apr. 3, 2020, issued Sep. 28, 2021, 7 pages.

Taiwan Examination Report received for TW Application No. 109111494 on Jul. 17, 2023, 22 pgs.

* cited by examiner

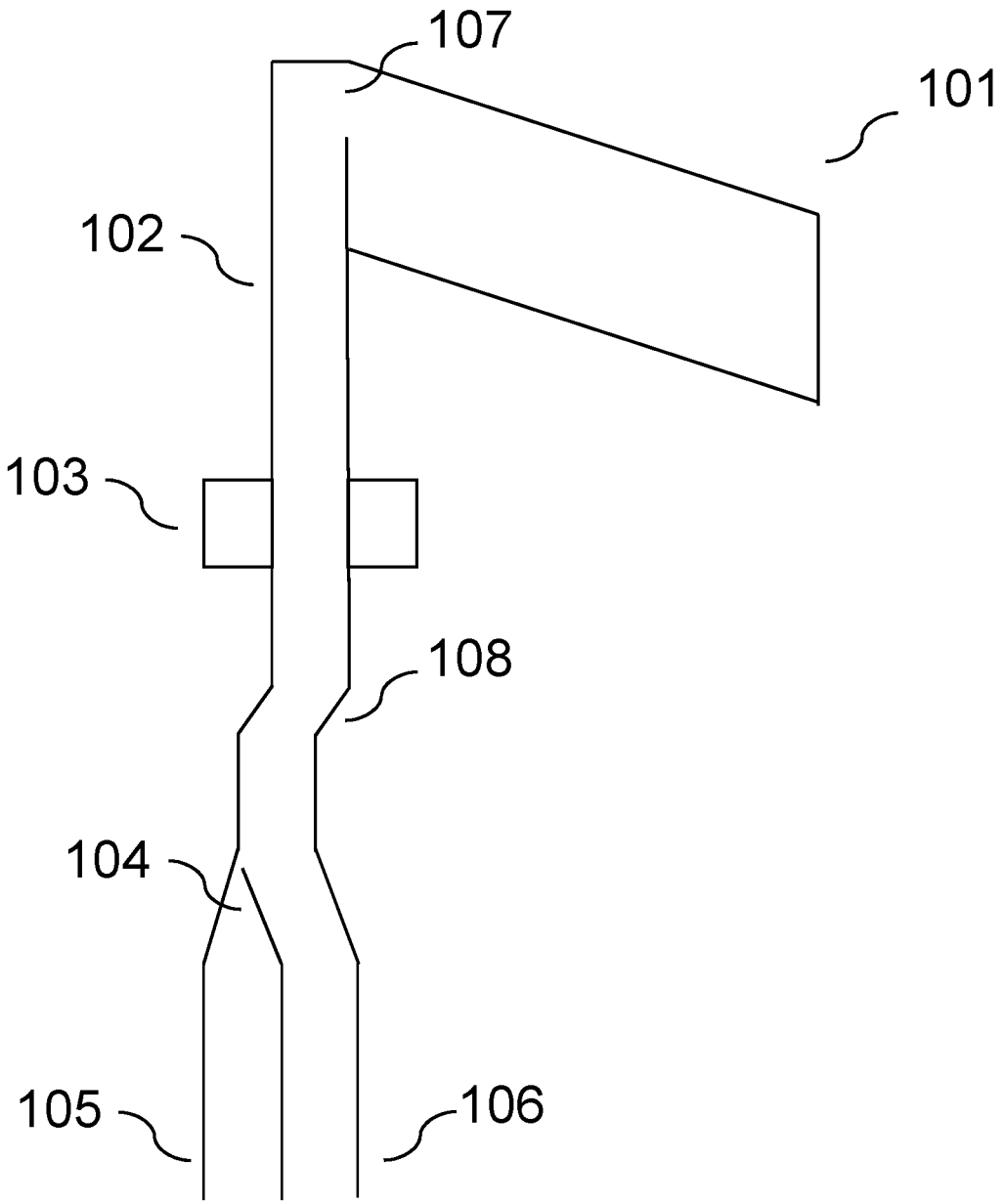
107
101
102
103
108
104
105
106

ICE DISPENSING SYSTEM

PRIORITY CLAIM

The present application is a National Phase entry of PCT Application No. PCT/EP2020/059605, filed Apr. 3, 2020, which claims priority from Great Britain Application No. 190722.4, filed Apr. 3, 2019, each of which is hereby fully incorporated herein by reference.

BACKGROUND

Known ice dispensers suffer from various problems. Existing ice dispensing systems are reliant on the user determining the amount of ice required and manually dispensing the required amount. Typically, ice is dispensed by a user holding a cup or other receptacle against a lever or holding a cup underneath the dispenser and pressing a button. The amount of ice dispensed therefore varies, as it is determined by the user. There is also usually a lag between the user releasing the lever or button and the cessation of ice delivery to the receptacle. This means that often more ice is dispensed than the user intended, which can lead to overfilling of the receptacle. In anticipation of potential overfilling, a user may release the lever or button early resulting in under filling of the receptacle. In other words, it is difficult for a user to dispense the desired quantity of ice.

Where ice dispensers are used alongside beverage machines, such as a self-service beverage dispenser in a fast food restaurant, the user must carry out multiple steps to dispense an iced beverage. The user must first take a cup from one portion of the beverage dispensing area and then move the cup to the ice dispenser. Here, the user must fill the cup with their desired amount of ice by pressing the cup against a lever, or by holding down a button or similar on the ice dispenser. The user must then move the cup to the beverage dispensing portion and top up the cup with their desired amount of beverage. It would be desirable to provide a combined beverage and ice dispensing system where the user does not have to move the cup during operation of the system.

Integrated beverage and ice dispensing machines are known, such as the type disclosed in WO9932392. However, such machines are complicated and bulky. The action of dispensing ice and dispensing a beverage do not occur at the same site. Therefore, the footprint of the machine is increased greatly. The machine also requires multiple moving parts such as a cup carousel and conveyor belt to move cups between ice and beverage dispensing outlets. In this case, the dispensing of ice is controlled by opening an ice door for a pre-set period of time. This can lead to inaccuracies and inconsistencies in the amount of ice that is dispensed due to, for example, variation in ice distribution in the container within which the ice is stored.

In situations where a beverage having a predetermined volume and requiring a set amount of ice is desired, for example an iced coffee of a certain volume, the amount of ice dispensed needs to be precise in order to avoid over or under-filling the cup and to ensure that the correct balance of ice and beverage is achieved. Additionally, where the beverage and ice are to be automatically dispensed, the user will not be holding the cup in place. Ice must therefore be dispensed gently in order to avoid toppling the cup. There is a need for an improved ice dispensing system that addresses these issues.

SUMMARY OF THE INVENTION

In a first aspect, the invention provides an ice dispensing system comprising

- an ice hopper,
- an ice chute for transporting ice from the ice hopper to a dispensing outlet or a waste outlet,
- an ice dispensing element for dispensing ice from the hopper into the ice chute,
- an ice directing element having a first position for directing ice to the waste outlet and a second position for directing ice to the dispensing outlet, and
- a controller for controlling the ice dispensing element and the position of the ice directing element.

In a second aspect, the invention provides a beverage dispensing machine comprising beverage dispensing outlet and an ice dispensing system according to the first aspect of the invention.

In a third aspect, the invention provides a method for dispensing ice from an ice dispensing system or beverage dispensing machine of the invention comprising the steps of:

a. activating the ice dispensing element to dispense ice from the hopper into the ice chute and causing the directing element to move from the first position to the second position, b. deactivating the ice dispensing element and moving the directing element from the second position to the first position.

BRIEF DESCRIPTION OF THE DRAWING

FIG. 1 shows an ice dispensing system according to an embodiment.

DETAILED DESCRIPTION OF THE DRAWINGS

Figure

Embodiments of the invention will now be described, by way of example, with reference to FIG. 1 which shows a schematic drawing of an ice dispensing system according to one embodiment of the invention.

Ice Dispensing System

The ice dispensing system can be further understood with reference to FIG. 1, which shows an ice dispensing system comprising an ice hopper 101 in communication with an ice chute 102 via an ice outlet 107. In this embodiment, the ice chute 102 includes a control structure 108, directing element 104, a dispensing outlet 105 and a waste outlet 106. The control structure 108 is for slowing down falling ice. The directing element 104 has a first position for directing ice into the waste outlet 106, and a second position for directing ice into the dispensing outlet 105. In FIG. 1, the directing element 104 is shown in the first position. Ice passing through the ice chute 102 will therefore be directed to the waste outlet 106. The ice dispensing system further comprises an ice dispensing element (not shown) for dispensing ice from the hopper 101 into the ice chute 102. The ice dispensing system also comprises a controller (not shown) for controlling the ice dispensing element, and the position of the ice directing element 104.

The ice hopper 101 stores ice before it is dispensed into the ice chute 102. It will be appreciated that the term "ice" includes ice cubes and nuggets. Typically, ice will be stored and dispensed in the form of cubes or nuggets. The ice hopper may be of the type already known in the art, such as described in WO 2011/022140. The hopper 101 may comprise an ice outlet 107 that is closable by a moveable barrier. The barrier may be moved by engagement with the chute 102. Preferably, the ice outlet is above the base of the hopper 101. Preferably, the hopper is angled so that the ice outlet is at a raised end of the hopper. In this way, any melt water that forms within the hopper water collects at the opposing end of the hopper 101 and does not enter the ice chute. The ice hopper may by insulated to slow the melting of ice. The insulation may comprise foam or any other suitable material. The ice hopper may be surrounded by a watertight housing. The watertight housing may be fluidically connected to a waste module, and/or melt water/condensation tank and/or a waste line. The waste line may be configured to direct fluid to an external drain. The watertight housing may be formed of a metal, a food-safe plastic or other suitable food-safe material. Preferably, the watertight housing is transparent. A transparent housing permits visual hygiene inspections. The purpose of the watertight housing is to collect any condensation that forms on the outside of the ice hopper and ensure it does not drip on to any other component of the ice dispensing system or other systems or modules located in the vicinity of the ice dispensing system. This is particularly advantageous where the ice dispensing system is incorporated into a beverage dispensing machine as disclosed below.

The ice dispensing element is for dispensing ice from the ice hopper 101 into the ice chute 102. The ice dispensing element may be provided within the ice hopper, although other types of ice dispensing element are contemplated. The ice dispensing element may comprise or consist of an auger. The auger may be a wire auger. If the ice dispensing element is not provided within the ice hopper 101, it could be provided outside of the ice hopper 101. For example, an ice dispensing element could be configured to tilt the hopper 101 such that ice is dispensed into the ice chute 102 in a controlled manner. The ice dispensing element is preferably configured to direct ice towards the ice outlet 107 of the ice hopper 101.

The controller may be programmed to activate the ice dispensing element periodically (for example at regular intervals). This may be done in order to agitate the ice within the hopper to prevent the formation of clumps of ice, which can form through melting and refreezing. Alternatively, or additionally, activation of the ice dispensing element periodically (for example at regular intervals) may be used in order to remove ice, such as partially melted ice, from the hopper. In such embodiments, ice may be permitted to enter the ice chute. Preferably, when the ice dispensing element is activated in this manner, the ice directing element is in the first position, such that any ice removed from the hopper in this manner is directed to waste. Alternatively, or additionally, ice may be prevented from entering the ice chute when the ice dispensing element is activated, for example by blocking an ice outlet of the ice hopper with a moveable barrier. In such embodiments the movement of the ice dispensing element is preferably configured to prevent build-up of ice at the ice outlet and/or maintain an even distribution of ice throughout the hopper. Preventing ice entering the chute or ensuring the ice directing element is in the first position during activation of the ice dispensing element removes the possibility that the ice will end up in a user's cup or contaminate the surrounding area. Periodically activating the ice dispensing element in this way may be desirable in order to refresh and replenish the ice stored in the hopper. This keeps the size of the ice in the hopper uniform, and therefore the ice that is dispensed to the user is also of uniform size. Ensuring that the ice has a uniform size also improves dispensing accuracy. This is because, if the ice is of a uniform size, the amount of ice dispensed per dispensing action will be more consistent. For example, where the ice dispensing system includes an optical sensor, a more accurate count can be achieved if the ice is of a uniform size.

The ice chute is for transporting ice from the ice hopper to a dispensing outlet or a waste outlet. The ice chute 102 may be configured to engage the ice hopper 101 and open a moveable barrier covering an opening 107 of the hopper 101 to allow communication between the ice hopper 101 and the ice chute 102. Alternatively, where an ice outlet 107 in the ice hopper does not comprise a moveable barrier, the ice chute may be in constant communication with the ice hopper. The ice chute may be made from any suitable food-safe material, such as metal, plastic or combinations thereof. The waste outlet 106 may be provided as part of the ice chute or may be provided as a separate component that is capable of communication with the ice chute. The waste outlet may direct ice into a waste receptacle (e.g. a drip tray of a beverage machine), waste module or to a waste line (which may be connectable to a drain). A waste receptacle may feed into a separate waste module and/or waste line. The dispensing outlet 105 may be provided as part of the ice chute, or may be provided as a separate component that is capable of communication with the ice chute. Ice may pass from the dispensing outlet 105 directly into a receptacle, such as a user's cup. Alternatively, the dispensing outlet 105 may direct ice into a further conduit which may dispense the ice into a receptacle. The ice chute 102 may be straight or substantially straight. Preferably, the ice chute 102 comprises one or more control structures 108 such as a bend, twist, curve, kink, or projection for slowing down falling ice. A control structure 108 may be positioned between the dispensing outlet and the directing element. A control structure may be positioned between the ice hopper and the directing element. The ice chute may be substantially vertical, so that ice can move from the ice hopper to either outlet via the action of gravity.

The ice directing element has a first position for directing ice to the waste outlet and a second position for directing ice to the dispensing outlet. The controller controls the position of the ice directing element. When the system is not dispensing ice via the dispensing outlet, the ice directing element may be in the first position. The default position of the ice directing element may be the first position. In use, the ice directing element may or may not contact ice to bring about the directing effect. The ice directing element may direct ice directly or indirectly. Preferably, the ice directing element is located within the ice chute. In an embodiment, the ice dispensing element is a flap or plate. The flap/plate may, for example, permit access to the waste outlet the and block access to the dispensing outlet in the first position and permit access to the dispensing outlet and block access to the waste outlet in the second position, for example by rotating about a hinge. The rotation may be facilitated by an actuator controlled by the controller. In an embodiment, the ice directing member is not located within the ice chute. For example, the ice directing member may move the ice chute or a portion of the ice chute so that the ice chute aligns with the waste outlet when the ice directing member is in the first position and aligns with the dispensing outlet when the ice directing member is in the second position. Variations of this arrangement are also contemplated. For example, the ice directing element could move the position of the waste outlet and the dispensing outlet, while the ice chute remains in a fixed position.

In order to dispense ice, the controller activates the ice dispensing element to begin dispensing ice from the hopper into the ice chute. The controller also moves the ice directing element to the second position (for example by activating an actuator associated with the ice directing element) to direct ice passing through the ice chute to the dispensing outlet. The term "controller" relates to a control system which may include sub controllers, for example a sub controller for the ice directing element and a sub controller for the ice dispensing element. A single controller may control both the ice directing element and the ice dispensing element. The controller may perform these actions simultaneously or substantially simultaneously. The controller may perform these actions in response to an ice requirement signal. Such a signal may be initiated by a user. The system may be configured to dispense ice for as long as an ice requirement signal is provided (for example by a user holding down a switch or button). The ice requirement signal may be an "on demand" signal. The user may directly select the amount of ice, or may indirectly select the amount of ice by, for example, selecting a beverage option that is associated with a preset amount of ice. In a preferred embodiment, the ice dispensing system, e.g. the controller, is programmed with or has access to a number of preset amounts of ice. For example, a user may initiate an ice requirement signal associated with a preset amount of ice by selecting a desired quantity of ice from a number of options, for example using a slider icon on a user interface, or selecting a beverage associated with a particular quantity of ice. The ice requirement signal may therefore be associated with a preset amount of ice. This information can be used to control the ice dispensing element and the ice directing element to ensure that the desired amount of ice is dispensed. The preset amounts of ice may be gradated in a number of steps from the minimum preset amount of ice to the maximum preset amount of ice. When the controller determines that the desired preset amount of ice has been dispensed, it causes the ice directing element to move to the first position (for example by activating an actuator associated with the ice directing element) and deactivates the ice dispensing element (preferably simultaneously or substantially simultaneously). Alternatively, when the controller determines that the preset amount of ice has been dispensed, it deactivates the ice dispensing element. The ice directing element may remain in the second position and may be moved back to the first position at a later stage. Deactivating the ice dispensing element prevents further ice being dispensed from the hopper 101 into the chute 102. The advantage of moving the directing element to the first position is that ice that has already entered the ice chute after it has been determined that sufficient ice has been dispensed will be directed to the waste outlet, and no further ice will be dispensed from the dispensing outlet. This can prevent overfilling of the cup (or other receptacle) receiving ice from the dispenser. Another advantage of moving the directing element to the first position (or having the first position as the default position) is that any ice stuck at the ice hopper outlet or drips of meltwater will be directed to waste if they fall into the ice chute. This keeps the dispensing area free from excess ice/water and/or prevents overfilling of the cup (or other receptacle) receiving ice from the dispenser. A further advantage of moving the directing element to the first position (or having the first position as the default position) is that access to the ice chute and ice hopper via the dispensing outlet is prevented. This minimizes contamination of the food-safe areas of the system and therefore provides a hygiene benefit. Dispensing ice in accordance with the invention allows for a controllable, reproducible and precise amount of ice to be dispensed. The system of the invention may be configured to permit both "on demand" ice dispensing and preset quantity dispensing as described above.

In some embodiments, the ice dispensing system comprises an ice sensor 103. The ice sensor may be configured to sense ice passing through the ice chute 102, for example as shown in FIG. 1. The ice sensor is preferably an optical sensor. However, the ice sensor may be a mechanical sensor e.g. switch that is contacted and activated by falling ice or a capacitive sensor. For example, a paddle switch may extend into the ice chute. The sensor may be positioned between the ice hopper and the directing element. The ice sensor may be positioned within the ice hopper, for example at the ice outlet. For example, a paddle switch may be positioned at or in proximity to the ice outlet. Preferably, the sensor is positioned closer to the directing element than the ice hopper. If the ice sensor is an optical sensor, preferably the sensor is configured to direct an optical beam through the chute such that the beam spans the width of the ice chute. Ice moving past the sensor will break the beam of the sensor. The sensor may be configured such that the beam is positioned between the ice hopper and ice directing element. This information can be used by the controller to calculate the amount of ice that has passed the sensor. This can provide an indication of the amount of ice that has been dispensed from the dispensing outlet 105. Preferably, the ice sensor 103 detects passing ice and sends a count to the controller. The controller preferably receives a count from the ice sensor 103 each time the sensor senses ice (e.g. an ice cube or nugget) passing the sensor. The controller may use this count to calculate the amount of ice that has passed the sensor. The controller may be programmed with or have access to one or more preset ice amounts, that can be selected according to an ice requirement. The preset amounts may be gradated in a number of steps between a minimum ice amount and the maximum ice amount to be dispensed from the system. The controller may compare the amount of ice that has passed the sensor (i.e. the count) to a selected preset amount. The controller may move the ice directing element from the second position to the first position when a preset amount of ice has been counted by the ice sensor. The controller may deactivate the ice dispensing element when a preset amount of ice has been counted by the ice sensor. In an embodiment, the controller deactivates the ice dispensing element when a present amount of ice has been counted by the ice sensor, but does not move the ice directing element from the second position to the first position, or does not move the ice directing element from the second position to the first position at the same time as deactivating the ice dispensing element. In some embodiments, the ice dispensing system includes a sensor that senses ice at a location other than the chute 102. For example, an ice sensor could be configured to detect ice that has collected in a receptacle. For example, a weight sensor may be provided in a receptacle supporting surface. Such a sensor may send a signal to the controller when a weight, that is associated with a preset desired amount of ice, has been detected. The controller may deactivate the ice dispensing element to stop dispensing ice when a preset amount of ice has been sensed by the ice sensor. The controller may deactivate the ice dispensing element to stop dispensing ice and, simultaneously or substantially simultaneously, move the ice directing element from the second position to the first position. Alternatively, when the controller determines that the preset amount of ice has been dispensed it may deactivate the ice dispensing element. The ice directing element may remain in the second position and may be moved back to the first position at a later stage.

If the ice dispensing system does not include a sensor, the amount of ice that is dispensed may be controlled by other means. For example, the controller may activate the ice dispensing element for a set period of time during which the desired amount of ice will be dispensed in to the chute. In such embodiments, once the set period of time has elapsed, the controller preferably deactivates the ice dispensing element and moves the ice directing element to the first position (for example simultaneously or substantially simultaneously). This ensures that ice that has already entered the ice chute after the set period of time has elapsed is not dispensed via the dispensing outlet and instead is directed to the waste outlet. Alternatively, once the set period of time has elapsed, the controller may deactivate the ice dispensing element. The ice directing element may be moved to the first position at a later stage.

The ice dispensing system may also include a waste module and/or melt water/condensation tank. The ice hopper may be fluidically connected to the waste module and/or melt water/condensation tank. Said connection may be a flexible tube or a pipe. Preferably, the connection is a reinforced flexible plastic tube. The waste module or melt water/condensation tank are preferably lower than the ice hopper. This allows any melt water within the hopper to be removed easily by a gravity drain or waste pump. Removal of melt water in this manner reduces the likelihood of ice refreezing and forming a mass that is difficult to break up. Formation of such ice clumps could cause the ice dispensing system to stop working, requiring maintenance and increasing associated costs. The capacity of the waste module and/or melt water/condensation tank should be equal to or preferably exceed the capacity of the ice hopper. This is advantageous in the event that the ice in the hopper melts, for example as the result of a power failure. In such circumstances, the melted ice will drain to the waste module/meltwater tank instead of flooding the system.

One advantage of the present invention is that the user is not required to hold a cup (or other receptacle) in position, for example against a lever or button, in order to dispense ice. To reduce the likelihood that falling ice will knock over the cup or move the cup out of position, the ice dispensing system may further comprise a cup guide for maintaining position of the cup below the dispensing outlet. The cup guide may be formed of metal or plastic. Preferably, the cup guide is shaped to grip the cup. However, the cup guide must not grip the cup so firmly that the user cannot easily place or remove the cup. In some embodiments, the cup guide does not grip the cup, but instead acts as a positioning guide to ensure the cup is correctly located below the ice dispensing outlet. For example, the cup guide may comprise a depression or well in a cup-supporting surface. The inclusion of a control structure in the ice chute as described herein also reduces the possibility that the cup will be knocked over or out of position by ice falling into the cup.

The ice dispensing system may also include a sensor for detecting the presence of a cup (or other receptacle), and/or cup size. The sensor may be optical or mechanical. The purpose of the sensor is to ensure ice is not dispensed unless a cup and/or or the correct size cup is present. Dispensing ice when there is no cup present may lead to contamination of the surrounding area with ice and melt-water, which is hazardous and could damage the ice dispensing system.

The ice dispensing system may include an ice making apparatus and an ice transport conduit for transporting ice from the ice making apparatus to the ice hopper. The ice making apparatus may be of the type disclosed in WO2005/086666 in which an augur is used to scrape ice from the inner wall of an evaporator and push the ice towards one end of the auger, compressing the ice into a solid mass. The solid mass can be transported to the ice hopper and broken into ice nuggets/cubes by including a bend in an ice transport conduit.

The ice dispensing system may also include a water supply line for supplying the ice making apparatus and a sterilizer such as a UV filter in the water supply line. The integration of a sterilizer in the water supply line ensures that all water used to produce ice is sterilized. The water supply line may also be for supplying cool drinking water to the user.

The ice dispensing system described herein may also comprise a user interface. The user interface may allow a user to select a desired amount of ice to be dispensed. The amount of ice may be selected indirectly. For example, a user may select a cup size or receptacle, or beverage option that is associated with a pre-set amount of ice. The user interface could take the form of buttons and may comprise a screen for displaying options. The user interface may comprise a touchscreen.

Integration into a Beverage Dispensing Machine

The ice dispensing system disclosed herein may be incorporated into a beverage dispensing machine to allow for the dispensing of iced beverages. In one aspect, the present invention provides a beverage dispensing machine comprising an ice dispensing system of the invention. It is particularly advantageous to incorporate an ice dispensing system of the type disclosed herein into a beverage dispensing machine as the precise metering of the amount of ice dispensed ensures that over or under-filling is avoided when an iced beverage is dispensed.

The ice dispensing system of the invention can be incorporated into a beverage dispensing machine for dispensing any type of beverage. In a preferred embodiment set out below, the ice dispensing system of the invention is incorporated into a beverage dispensing machine for dispensing hot, cool or cold beverages, including, for example, coffee-based beverages, such as the type described in WO2014/075833. The beverage dispensing machine comprises a beverage dispensing outlet. This outlet may be positioned above a cup/receptacle supporting surface. Preferably, the ice dispensing outlet is positioned in/on the beverage dispensing machine such that ice is dispensed in close proximity to the beverage dispensing outlet. This means that a cup (or other receptacle) can receive both ice and beverage without having to be moved.

The beverage dispensing machine may further comprise a body and a door attached thereto. The beverage dispensing outlet and/or ice dispensing outlet may cooperate with an aperture in the door to form a service port. The body may further comprise a plurality of operational modules (which may be removable and replaceable), and a control system for controlling operation of the modules. The door may further comprise a user interface. The user interface preferably facilitates user interaction with the control system. The door of the beverage dispensing machine may be opened to allow access to the internal modules for cleaning and/or maintenance. The operational modules may comprise at least one of a brewer, grinder, boiler, chocolate drink, chocolate powder, flavoring, water, hydraulic, pump, milk, internal waste, and cooling/refrigeration modules. The user interface may provide a menu of beverages. The controller may be configured to cause the ice dispensing system to dispense a pre-set amount of ice according to the beverage selected.

The ice chute may be mounted on the inside of the door of the beverage machine. Mounting the ice chute on the inside of the door is advantageous as the ice chute then does not block access to any internal modules when the door is opened. Where the ice chute is mounted on the inside of the door, it is advantageous that the ice hopper comprises an ice outlet that is closed by a moveable barrier and the ice chute is configured to engage the ice hopper and open the moveable barrier to allow communication between the ice hopper and the ice chute. This configuration allows for the ice outlet to be closed when the door to the beverage machine is open, ensuring no ice can escape the hopper. When the door is closed, placing the beverage machine in the operational configuration, the ice chute engages the ice hopper and opens the moveable barrier. This configuration opens the moveable barrier to allow communication between the ice hopper and the ice chute, meaning ice can be dispensed from the hopper into the ice chute.

In an alternative embodiment, the ice chute may be mounted to the body of the beverage machine. In this embodiment, the ice hopper may not include an ice outlet that is closed by a moveable barrier. Instead the ice chute may be in constant communication with the ice hopper.

Where the ice dispensing system is incorporated into a beverage dispensing system that comprises a control system for controlling operation of the modules said control system may also comprise a controller for controlling the ice dispensing element and the position of the ice directing element optionally in response to input received from the ice sensor, where present. Alternatively, the controller for controlling operation of the modules may also control the ice dispensing element and the position of the ice directing element, optionally in response to input received from the ice sensor, where present. The controller of the ice system may be integrated with the control system for other modules of the beverage dispensing machine or may be separate. Either controller can comprise an appropriate processor which can for example be provided in one or more PCBs.

The beverage dispensing system may comprise a sensor for detecting the presence of a cup, or the size of cup, as described herein. Detecting the correct size cup is desirable to ensure the cup is not over or underfilled. The user interface may be programmed to present a user with only beverages suitable for the selected cup size.

Where the ice dispensing system is integrated into a beverage dispensing machine, it allows for simple dispensing of a measured amount of ice without user intervention. For example, the user can simply place a cup underneath the dispensing outlet and select a desired beverage. Selectable iced beverages will be associated with a pre-set amount of ice. The control system can then cause the ice dispensing system to dispense the appropriate amount of ice for the selected drink. The control system can also cause the beverage dispensing outlet to dispense beverage into the cup. In this way, an iced beverage can be provided to a user with high accuracy and minimal user interaction. As both the amount of ice and amount of beverage that are dispensed is measured and controlled, there is no over or underfilling of the cup and the correct proportion of ice to beverage is achieved.

Methods for Dispensing Ice

The invention also provides a method for dispensing ice from an ice dispensing system or beverage dispensing machine of the invention comprising the steps of:

a. activating the ice dispensing element to dispense ice from the hopper into the ice chute and causing the directing element to move from the first position to the second position, b. deactivating the ice dispensing element and moving the directing element from the second position to the first position.

Preferably, the ice dispensing element is deactivated at the same time or substantially the same time as the directing element is moved from the second position to the first position. In another preferred embodiment, the ice directing element is moved from the second position to the first position after the ice dispensing element is deactivated. The ice dispensing element may be activated at the same time or substantially the same time as the directing element is moved from the first position to the second position.

The method may include receiving an ice requirement signal prior to activating the ice dispensing element. The ice requirement signal may be associated with a pre-set amount of ice. One or more pre-set amounts of ice may be stored in the ice dispensing system or beverage dispensing machine, for example in the controller. Step (b) of the method may be carried out once the controller has determined that the pre-set amount of ice has been dispensed. This determination may be made by comparing information received from an ice sensor as described herein with the pre-set amount. Alternatively, step (b) may be carried out after a set period of time has elapsed. This period of time is preferably associated with a pre-set amount of ice. The ice dispensing system can be calibrated to determine and set the amount of time required to dispense each pre-set amount of ice. In another embodiment, step (b) may be carried out after a user-initiated ice requirement signal ceases. For example, the ice requirement signal may be generated by a user holding down a switch or button and may cease when the user stops holding down the button or switch. Thus, the ice requirement signal may be an "on demand" signal. The method therefore allows for the dispensing of precise amounts of ice, either pre-set amounts of ice or an amount chosen by the user. The ice requirement signal may be initiated by a user selecting a pre-set amount of ice, or an iced beverage on a user interface. Where the ice dispensing system is incorporated into a beverage dispensing machine as described herein, the ice requirement signal may be initiated by a user selecting a beverage that requires ice.

Preferred features of each aspect of the invention are as for each of the other aspects mutatis mutandis. Documents cited here are incorporated by reference to the fullest extent permitted by law.

The invention claimed is:

1. An ice dispensing system comprising an ice hopper, a dispensing outlet, a waste outlet, an ice chute for transporting ice from the ice hopper to the dispensing outlet or the waste outlet, an ice dispensing element for dispensing ice from the hopper into the ice chute, an ice directing element having a first position for directing ice to the waste outlet and a second position for directing ice to the dispensing outlet, and a controller for controlling the ice dispensing element and the position of the ice directing element, wherein the controller is programmed to activate the ice dispensing element periodically to agitate the ice and/or remove ice from the ice hopper and, if the ice directing element is not in the first position when the ice dispensing element is periodically activated, move the ice directing element to the first position before activating the ice dispensing element such that any ice removed from the ice hopper by the ice dispensing element is directed to the waste outlet.

2. The ice dispensing system of claim 1, wherein the controller is programmed with or has access to one or more preset amounts of ice.

3. The ice dispensing system of claim 1 further comprising an ice sensor for sensing ice passing through the ice chute.

4. The ice dispensing system of claim 3, wherein the ice sensor is an optical sensor, configured such that a beam of the sensor spans the width of the ice chute.

5. The ice dispensing system of claim 4, wherein the beam spans the ice chute at a location between the ice hopper and the directing element.

6. The ice dispensing system of claim 3, wherein the controller controls the ice dispensing element and/or the position of the ice directing element in response to input received from the ice sensor.

7. The ice dispensing system of claim 6, wherein the controller is programmed with or has access to one or more preset amounts of ice and wherein the controller is configured to compare an ice count received from the ice sensor to a selected preset amount of ice.

8. The ice dispensing system of claim 7, wherein the controller is configured to deactivate the ice dispensing element and move the ice directing element from the second position to the first position, when it has been determined that the selected preset amount of ice has been dispensed.

9. The ice dispensing system of claim 1, wherein the default position of the ice directing element is the first position.

10. The ice dispensing system of claim 1, wherein the ice directing element is a flap or plate located within the ice chute.

11. The ice dispensing system of claim 1, wherein the controller is configured to activate the ice dispensing element to dispense ice from the ice hopper and move the ice directing element from the first position to the second position in response to an ice requirement signal such that ice can be dispensed from the dispensing outlet, wherein the controller is configured to move the ice directing element from the first position to the second position and activate the ice dispensing element simultaneously or substantially simultaneously.

12. The ice dispensing system of claim 1, wherein the ice dispensing element is an auger located within the ice hopper.

13. The ice dispensing system of claim 1, wherein the ice hopper comprises an ice outlet that is closed by a moveable barrier.

14. The ice dispensing system of claim 13, wherein the ice chute is configured to engage the ice hopper and open the moveable barrier to allow communication between the ice hopper and the ice chute.

15. The ice dispensing system of claim 1, wherein the ice dispensing system includes an ice making apparatus and an ice transport conduit for transporting ice from the ice making apparatus to the ice hopper.

16. The ice dispensing system of claim 15, further comprising a water supply line for supplying the ice making apparatus and a sterilizer, such as a UV filter, in the water supply line.

17. The ice dispensing system of claim 1, wherein the ice chute comprises a control structure for slowing down falling ice, wherein the control structure includes at least one of a bend, twist, curve, kink, or projection.

18. The ice dispensing system of claim 17 wherein the control structure is positioned between the dispensing outlet and the directing element.

19. The ice dispensing system of claim 1, wherein the ice hopper is surrounded by a watertight housing.

20. The ice dispensing system of claim 19, wherein the watertight housing is connected to a waste module by a waste pump or gravity drain.

21. The ice dispensing system of claim 1, wherein the ice dispensing system further comprises a cup guide for maintaining position of a cup below the dispensing outlet.

* * * * *